US008224645B2

(12) United States Patent
Conkie

(10) Patent No.: US 8,224,645 B2
(45) **Date of Patent: *Jul. 17, 2012**

(54) METHOD AND SYSTEM FOR PRESELECTION OF SUITABLE UNITS FOR CONCATENATIVE SPEECH

(75) Inventor: Alistair D. Conkie, Morristown, NJ (US)

(73) Assignee: AT+T Intellectual Property II, L.P., Atlanta, GA (US)

( * ) Notice: Subject to any disclaimer, the term of this patent is extended or adjusted under 35 U.S.C. 154(b) by 198 days.

This patent is subject to a terminal disclaimer.

(21) Appl. No.: 12/325,809

(22) Filed: Dec. 1, 2008

(65) Prior Publication Data

US 2009/0094035 A1 Apr. 9, 2009

Related U.S. Application Data

(63) Continuation of application No. 11/466,229, filed on Aug. 22, 2006, now Pat. No. 7,460,997, which is a continuation of application No. 10/702,154, filed on Nov. 5, 2003, now Pat. No. 7,124,083, which is a continuation of application No. 09/607,615, filed on Jun. 30, 2000, now Pat. No. 6,684,187.

(51) Int. Cl.
*G10L 13/00* (2006.01)
*G10L 13/04* (2006.01)

(52) U.S. Cl. ..... 704/258; 704/260; 704/266

(58) Field of Classification Search ..... 704/258, 704/260, 266, 269

See application file for complete search history.

(56) References Cited

U.S. PATENT DOCUMENTS 5,384,893 A 1/1995 Hutchins
5,440,663 A 8/1995 Moese et al.
5,659,664 A 8/1997 Kaja
5,794,197 A 8/1998 Alleva et al.
5,850,629 A * 12/1998 Holm et al. ..... 704/260
5,905,972 A 5/1999 Huang et al.
5,913,193 A 6/1999 Huang et al.
5,913,194 A 6/1999 Karaali et al.

(Continued)

FOREIGN PATENT DOCUMENTS

EP 0942409 A2 9/1999

(Continued)

OTHER PUBLICATIONS

Hon et al., "Automatic Generation of Synthesis Units for Trainable Text-to-Speech Systems", Microsoft Research, One Microsoft Way, Redmond, Washington 98052, IEEE 1998.

(Continued)

*Primary Examiner* — Martin Lerner

(57) ABSTRACT

A system and method for improving the response time of text-to-speech synthesis using triphone contexts. The method includes receiving input text, selecting a plurality of N phoneme units from a triphone unit selection database as candidate phonemes for synthesized speech based on the input text, wherein the triphone unit selection database comprises triphone units each comprising three phones and if the candidate phonemes are available in the triphone unit selection database, applying a cost process to select a set of phonemes from the candidate phonemes. If no candidate phonemes are available in the triphone unit selection database, the method includes applying a single phoneme approach to select single phonemes for synthesis, which single phonemes are used in synthesis independent of a triphone structure. The method also includes synthesizing speech using at least one of the set of phonemes from the candidate phonemes and the selected single phonemes for synthesis from the single phoneme approach.

15 Claims, 5 Drawing Sheets

U.S. PATENT DOCUMENTS

| | | | | |
|---|---|---|---|---|
| 5,937,384 | A | 8/1999 | Huang et al. | |
| 5,949,961 | A * | 9/1999 | Sharman | 704/260 |
| 5,970,454 | A * | 10/1999 | Breen | 704/269 |
| 5,978,764 | A | 11/1999 | Lowry et al. | |
| 5,987,412 | A * | 11/1999 | Breen | 704/260 |
| 6,003,005 | A * | 12/1999 | Hirschberg | 704/260 |
| 6,041,300 | A | 3/2000 | Ittycheriah et al. | |
| 6,163,769 | A | 12/2000 | Acert et al. | |
| 6,173,263 | B1 | 1/2001 | Conkie | |
| 6,253,182 | B1 | 6/2001 | Acero | |
| 6,304,846 | B1 | 10/2001 | George et al. | |
| 6,317,712 | B1 | 11/2001 | Kao et al. | |
| 6,330,538 | B1 * | 12/2001 | Breen | 704/260 |
| 6,366,883 | B1 | 4/2002 | Campbell et al. | |
| 6,502,074 | B1 * | 12/2002 | Breen | 704/260 |
| 6,505,158 | B1 | 1/2003 | Conkie | |
| 6,665,641 | B1 | 12/2003 | Coorman et al. | |
| 6,684,187 | B1 | 1/2004 | Conkie | |
| 7,013,278 | B1 | 3/2006 | Conkie | |
| 7,124,083 | B2 | 10/2006 | Conkie | |
| 7,139,712 | B1 * | 11/2006 | Yamada | 704/266 |
| 7,209,882 | B1 | 4/2007 | Cosatto et al. | |
| 7,233,901 | B2 * | 6/2007 | Conkie | 704/260 |
| 7,266,497 | B2 * | 9/2007 | Conkie et al. | 704/258 |
| 7,289,958 | B2 | 10/2007 | Bernard et al. | |
| 7,369,992 | B1 | 5/2008 | Cosatto et al. | |
| 7,460,997 | B1 * | 12/2008 | Conkie | 704/258 |
| 7,565,291 | B2 * | 7/2009 | Conkie | 704/258 |
| 7,587,320 | B2 * | 9/2009 | Conkie et al. | 704/256 |
| 7,912,718 | B1 * | 3/2011 | Conkie et al. | 704/258 |
| 7,983,919 | B2 * | 7/2011 | Conkie | 704/260 |
| 8,131,547 | B2 * | 3/2012 | Conkie et al. | 704/256 |
| 2001/0044724 | A1 | 11/2001 | Hon et al. | |
| 2003/0125949 | A1 * | 7/2003 | Okutani et al. | 704/258 |

FOREIGN PATENT DOCUMENTS

| | | | |
|---|---|---|---|
| EP | 0953970 | A2 | 11/1999 |
| EP | 0942409 | A3 | 1/2000 |
| EP | 1168299 | | 1/2002 |
| GB | 2313530 | A | 11/1997 |
| JP | 06095696 | A | 4/1994 |
| WO | WO00/30069 | | 5/2000 |

OTHER PUBLICATIONS

Kitai M. et al. "ASR and TTS Tele-Communications Applications in Japan", no date. Speech Communications, Oct. 1997, Elsevier Netherlands, vol. 23, No. 1-2, pp. 17-30, ma & year only.

Beutnagel et al. "Rapid unit selection from a large speech corpus for concatenative speech synthesis", Proceedings Eurospeech, Sep. 5, 1999, pp. 1-4.

Bhaskararao et al. "Use of triphones for demisyllable-based speech synthesis", Internation Conference on Acoustics, Speech & Signal Processing, ICASSP, Apr. 14, 1991, pp. 517-520.

Holzapfel et al. "A Nonlinear Unit Selection Strategy for Concatenative Speech Synthesis Based on Syllable", PRoceedings ICSLP, Oct. 1, 1998, pp. 1-4.

* cited by examiner

METHOD AND SYSTEM FOR PRESELECTION OF SUITABLE UNITS FOR CONCATENATIVE SPEECH

PRIORITY CLAIM

The present application is a continuation of U.S. patent application Ser. No. 11/466,229, filed Aug. 22, 2006, now U.S. Pat. No. 7,460,997, issued on Dec. 2, 2008, which is a continuation of U.S. patent application Ser. No. 10/702,154, filed Nov. 5, 2003, now U.S. Pat. No. 7,124,083, which is a continuation of U.S. patent application Ser. No. 09/607,615, filed Jun. 30, 2000, now U.S. Pat. No. 6,684,187, the contents of which are incorporated herein by reference.

TECHNICAL FIELD

The present invention relates to a system and method for increasing the speed of a unit selection synthesis system for concatenative speech synthesis and, more particularly, to predetermining a universe of phonemes—selected on the basis of their triphone context—that are potentially used in speech. Real-time selection is then performed from the created phoneme universe.

BACKGROUND OF THE INVENTION

A current approach to concatenative speech synthesis is to use a very large database for recorded speech that has been segmented and labeled with prosodic and spectral characteristics, such as the fundamental frequency (F0) for voiced speech, the energy or gain of the signal, and the spectral distribution of the signal (i.e., how much of the signal is present at any given frequency). The database contains multiple instances of speech sounds. This multiplicity permits the possibility of having units in the database that are much less stylized than would occur in a diphone database (a "diphone" being defined as the second half of one phoneme followed by the initial half of the following phoneme, a diphone database generally containing only one instance of any given diphone). Therefore, the possibility of achieving natural speech is enhanced with the "large database" approach.

For good quality synthesis, this database technique relies on being able to select the "best" units from the database—that is, the units that are closest in character to the prosodic specification provided by the speech synthesis system, and that have a low spectral mismatch at the concatenation points between phonemes. The "best" sequence of units may be determined by associating a numerical cost in two different ways. First, a "target cost" is associated with the individual units in isolation, where a lower cost is associated with a unit that has characteristics (e.g., F0, gain, spectral distribution) relatively close to the unit being synthesized, and a higher cost is associated with units having a higher discrepancy with the unit being synthesized. A second cost, referred to as the "concatenation cost", is associated with how smoothly two contiguous units are joined together. For example, if the spectral mismatch between units is poor, perhaps even corresponding to an audible "click", there will be a higher concatenation cost.

Thus, a set of candidate units for each position in the desired sequence can be formulated, with associated target costs and concatenative costs. Estimating the best (lowest-cost) path through the network is then performed using a Viterbi search. The chosen units may then be concatenated to form one continuous signal, using a variety of different techniques.

While such database-driven systems may produce a more natural sounding voice quality, to do so they require a great deal of computational resources during the synthesis process. Accordingly, there remains a need for new methods and systems that provide natural voice quality in speech synthesis while reducing the computational requirements.

SUMMARY OF THE INVENTION

The need remaining in the prior art is addressed by the present invention, which relates to a system and method for increasing the speed of a unit selection synthesis system for concatenative speech and, more particularly, to predetermining a universe of phonemes in the speech database, selected on the basis of their triphone context, that are potentially used in speech, and performing real-time selection from this precalculated phoneme universe.

In accordance with the present invention, a triphone database is created where for any given triphone context required for synthesis, there is a complete list, precalculated, of all the units (phonemes) in the database that can possibly be used in that triphone context. Advantageously, this list is (in most cases) a significantly smaller set of candidates units than the complete set of units of that phoneme type. By ignoring units that are guaranteed not to be used in the given triphone context, the selection process speed is significantly increased. It has also been found that speech quality is not compromised with the unit selection process of the present invention.

Depending upon the unit required for synthesis, as well as the surrounding phoneme context, the number of phonemes in the preselection list will vary and may, at one extreme, include all possible phonemes of a particular type. There may also arise a situation where the unit to be synthesized (plus context) does not match any of the precalculated triphones. In this case, the conventional single phoneme approach of the prior art may be employed, using the complete set of phonemes of a given type. It is presumed that these instances will be relatively infrequent.

Other and further aspects of the present invention will become apparent during the course of the following discussion and by reference to the accompanying drawings.

BRIEF DESCRIPTION OF THE DRAWINGS

Referring now to the drawings.

DETAILED DESCRIPTION

Figure 1:
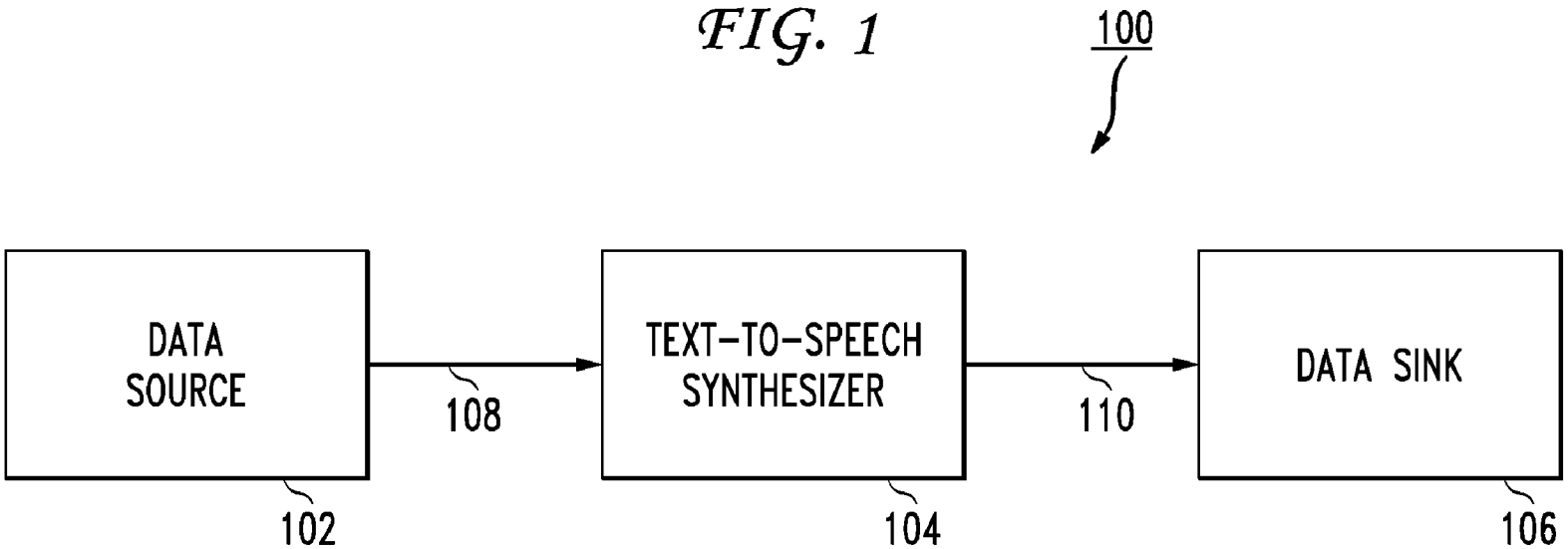
FIG. 1 illustrates an exemplary speech synthesis system for utilizing the unit (e.g., phoneme) selection arrangement of the present invention.

An exemplary speech synthesis system 100 is illustrated in FIG. 1. System 100 includes a text-to-speech synthesizer 104 that is connected to a data source 102 through an input link 108, and is likewise connected to a data sink 106 through an output link 110. Text-to-speech synthesizer 104, as discussed in detail below in association with FIG. 2, functions to convert the text data either to speech data or physical speech. In operation, synthesizer 104 converts the text data by first converting the text into a stream of phonemes representing the speech equivalent of the text, then processes the phoneme stream to produce an acoustic unit stream representing a clearer and more understandable speech representation. Synthesizer 104 then converts the acoustic unit stream to speech data or physical speech. In accordance with the teachings of the present invention, as discussed in detail below, database units (phonemes) accessed according to their triphone context, are processed to speed up the unit selection process.

Data source 102 provides text-to-speech synthesizer 104, via input link 108, the data that represents the text to be synthesized. The data representing the text of the speech can be in any format, such as binary, ASCII, or a word processing file. Data source 102 can be any one of a number of different types of data sources, such as a computer, a storage device, or any combination of software and hardware capable of generating, relaying, or recalling from storage, a textual message or any information capable of being translated into speech. Data sink 106 receives the synthesized speech from text-to-speech synthesizer 104 via output link 110. Data sink 106 can be any device capable of audibly outputting speech, such as a speaker system for transmitting mechanical sound waves, or a digital computer, or any combination of hardware and software capable of receiving, relaying, storing, sensing or perceiving speech sound or information representing speech sounds.

Links 108 and 110 can be any suitable device or system for connecting data source 102/data sink 106 to synthesizer 104. Such devices include a direct serial/parallel cable connection, a connection over a wide area network (WAN) or a local area network (LAN), a connection over an intranet, the Internet, or any other distributed processing network or system. Additionally, input link 108 or output link 110 may be software devices linking various software systems.

Figure 2:
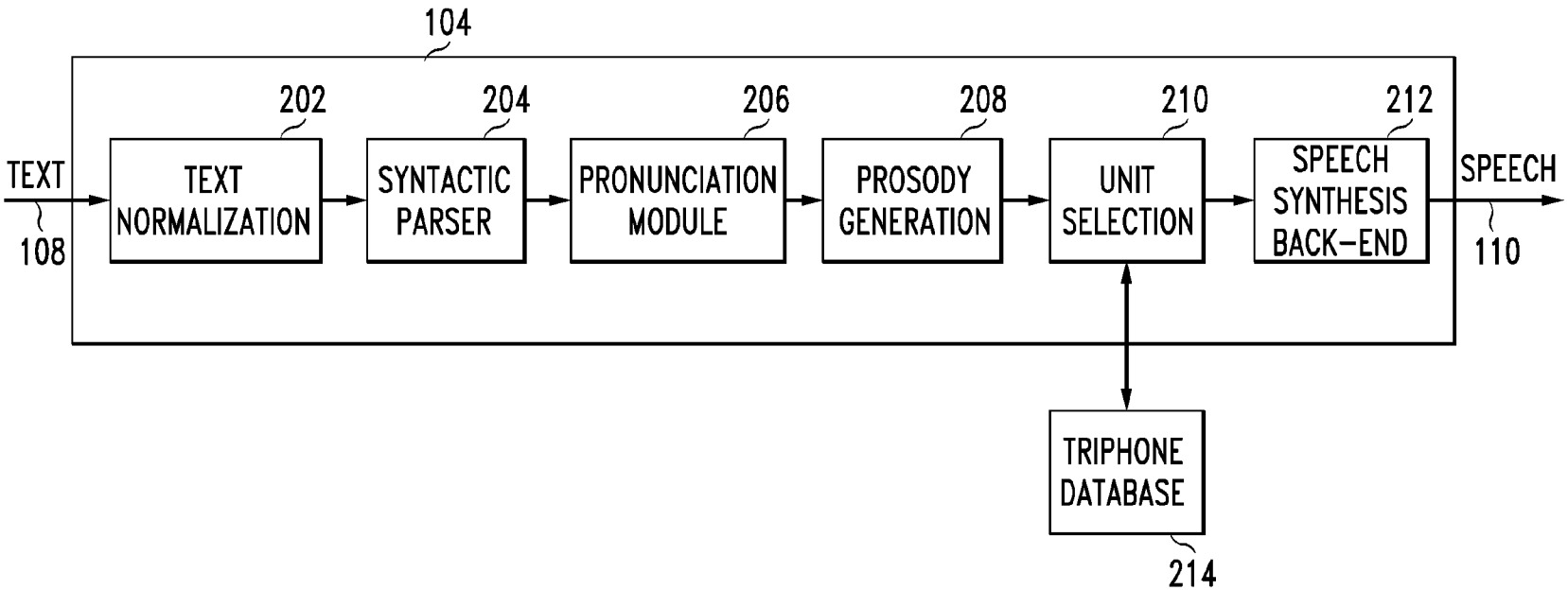
FIG. 2 illustrates, in more detail, an exemplary text-to-speech synthesizer that may be used in the system of FIG. 1.

FIG. 2 contains a more detailed block diagram of text-to-speech synthesizer 104 of FIG. 1. Synthesizer 104 comprises, in this exemplary embodiment, a text normalization device 202, syntactic parser device 204, word pronunciation module 206, prosody generation device 208, an acoustic unit selection device 210, and a speech synthesis back-end device 212. In operation, textual data is received on input link 108 and first applied as an input to text normalization device 202. Text normalization device 202 parses the text data into known words and further converts abbreviations and numbers into words to produce a corresponding set of normalized textual data. For example, if "St." is input, text normalization device 202 is used to pronounce the abbreviation as either "saint" or "street", but not the /st/ sound. Once the text has been normalized, it is input to syntactic parser 204. Syntactic processor 204 performs grammatical analysis of a sentence to identify the syntactic structure of each constituent phrase and word. For example, syntactic parser 204 will identify a particular phrase as a "noun phrase" or a "verb phrase" and a word as a noun, verb, adjective, etc. Syntactic parsing is important because whether the word or phrase is being used as a noun or a verb may affect how it is articulated. For example, in the sentence "the cat ran away", if "cat" is identified as a noun and "ran" is identified as a verb, speech synthesizer 104 may assign the word "cat" a different sound duration and intonation pattern than "ran" because of its position and function in the sentence structure.

Once the syntactic structure of the text has been determined, the text is input to word pronunciation module 206. In word pronunciation module 206, orthographic characters used in the normal text are mapped into the appropriate strings of phonetic segments representing units of sound and speech. This is important since the same orthographic strings may have different pronunciations depending on the word in which the string is used. For example, the orthographic string "gh" is translated to the phoneme /f/ in "tough", to the phoneme /g/ in "ghost", and is not directly realized as any phoneme in "though". Lexical stress is also marked. For example, "record" has a primary stress on the first syllable if it is a noun, but has the primary stress on the second syllable if it is a verb. The output from word pronunciation module 206, in the form of phonetic segments, is then applied as an input to prosody determination device 208. Prosody determination device 208 assigns patterns of timing and intonation to the phonetic segment strings. The timing pattern includes the duration of sound for each of the phonemes. For example, the "re" in the verb "record" has a longer duration of sound than the "re" in the noun "record". Furthermore, the intonation pattern concerning pitch changes during the course of an utterance. These pitch changes express accentuation of certain words or syllables as they are positioned in a sentence and help convey the meaning of the sentence. Thus, the patterns of timing and intonation are important for the intelligibility and naturalness of synthesized speech. Prosody may be generated in various ways including assigning an artificial accent or providing for sentence context. For example, the phrase "This is a test!" will be spoken differently from "This is a test?". Prosody generating devices are well-known to those of ordinary skill in the art and any combination of hardware, software, firmware, heuristic techniques, databases, or any other apparatus or method that performs prosody generation may be used. In accordance with the present invention, the phonetic output and accompanying prosodic specification from prosody determination device 208 is then converted, using any suitable, well-known technique, into unit (phoneme) specifications.

The phoneme data, along with the corresponding characteristic parameters, is then sent to acoustic unit selection device 210 where the phonemes and characteristic parameters are transformed into a stream of acoustic units that represent speech. An "acoustic unit" can be defined as a particular utterance of a given phoneme. Large numbers of acoustic units, as discussed below in association with FIG. 3, may all correspond to a single phoneme, each acoustic unit differing from one another in terms of pitch, duration, and stress (as well as other phonetic or prosodic qualities). In accordance with the present invention, a triphone preselection cost database 214 is accessed by unit selection device 210 to provide a candidate list of units, based on a triphone context, that are most likely to be used in the synthesis process. Unit selection device 210 then performs a search on this candidate list (using a Viterbi search, for example), to find the "least cost" unit that best matches the phoneme to be synthesized. The acoustic unit stream output from unit selection device 210 is then sent to speech synthesis back-end device 212 which converts the acoustic unit stream into speech data and transmits (referring to FIG. 1) the speech data to data sink 106 over output link 110.

Figure 3:
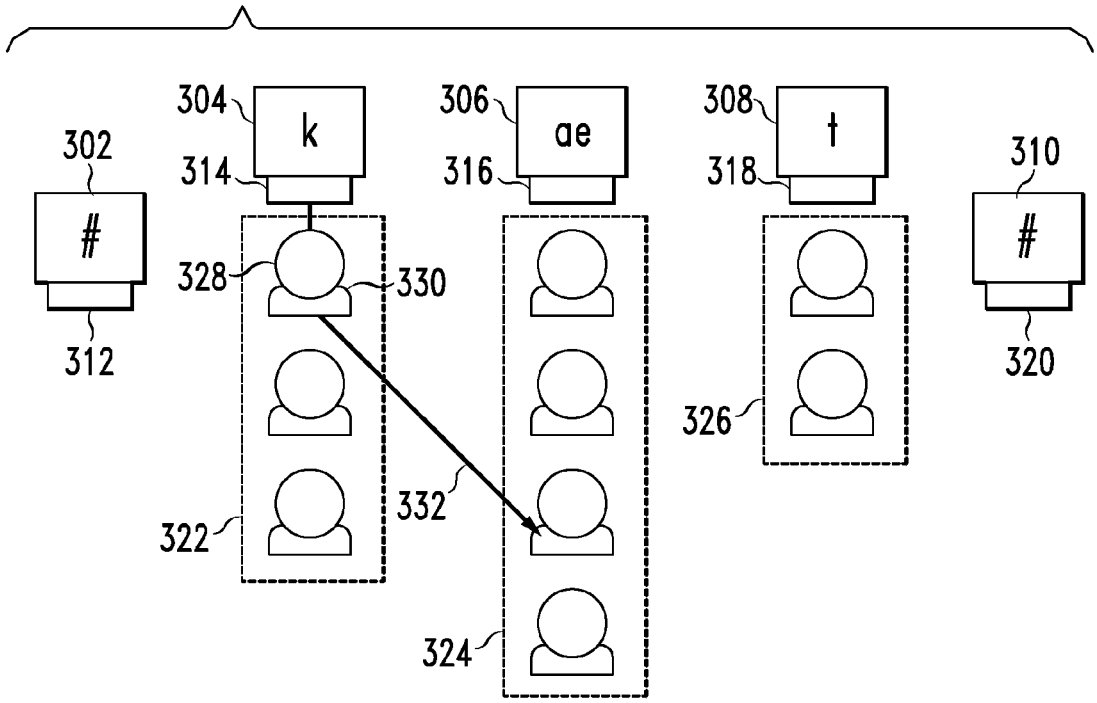
FIG. 3 illustrates an exemplary "phoneme" sequence and the various costs associated with this sequence.

FIG. 3 contains an example of a phoneme string 302-310 for the word "cat" with an associated set of characteristic parameters 312-320 (for example, F0, duration, etc.) assigned, respectively, to each phoneme and a separate list of acoustic unit groups 322, 324 and 326 for each utterance. Each acoustic unit group includes at least one acoustic unit 328 and each acoustic unit 328 includes an associated target cost 330, as defined above. A concatenation cost 332, as represented by the arrow in FIG. 3, is assigned between each acoustic unit 328 in a given group and an acoustic units 332 of the immediately subsequent group.

In the prior art, the unit selection process was performed on a phoneme-by-phoneme basis (or, in more robust systems, on half-phoneme—by—half-phoneme basis) for every instance of each unit contained in the speech database. Thus, when considering the /æ/ phoneme 306, each of its acoustic unit realizations 328 in speech database 324 would be processed to determine the individual target costs 330, compared to the text to be synthesized. Similarly, phoneme-by-phoneme processing (during run time) would also be required for /k/ phoneme 304 and /t/ phoneme 308. Since there are many occasions of the phoneme /æ/ that would not be preceded by /k/ and/or followed by /t/, there were many target costs in the prior art systems that were likely to be unnecessarily calculated.

Figure 4:
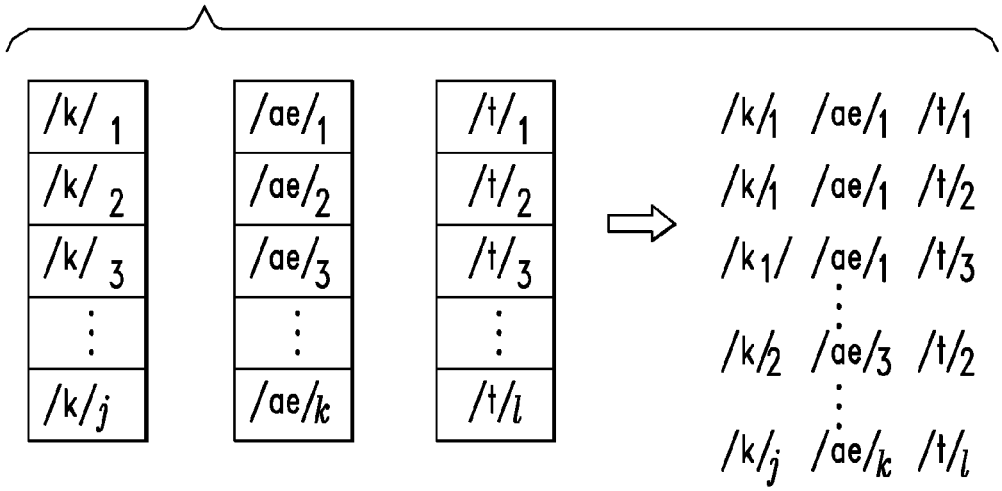
FIG. 4 contains an illustration of an exemplary unit (phoneme) database useful as the unit selection database in the system of FIG. 1.

In accordance with the present invention, it has been recognized that run-time calculation time can be significantly reduced by pre-computing the list of phoneme candidates from the speech database that can possibly be used in the final synthesis before beginning to work out target costs. To this end, a "triphone" database (illustrated as database 214 in FIG. 2) is created where lists of units (phonemes) that might be used in any given triphone context are stored (and indexed using a triphone-based key) and can be accessed during the process of unit selection. For the English language, there are approximately 10,000 common triphones, so the creation of such a database is not an insurmountable task. In particular, for the triphone /k/-/æ/-/t/, each possible /æ/ in the database is examined to determine how well it (and the surrounding phonemes that occur in the speech from which it was extracted) matches the synthesis specifications, as shown in FIG. 4. By then allowing the phonemes on either side of /k/ and /t/ to vary over the complete universe of phonemes, all possible costs can be examined that may be calculated at run-time for a particular phoneme in a triphone context. In particular, when synthesis is complete, only the N "best" units are retained for any 5-phoneme context (in terms of lowest concatenation cost; in one example N may be equal to 50). It is possible to "combine" (i.e., take the union of) the relevant units that have a particular triphone in common. Because of the way this calculation is arranged, the combination is guaranteed to be the list of all units that are relevant for this specific part of the synthesis.

In most cases, there will be number of units (i.e., specific instances of the phonemes) that will not occur in the union of possible all units, and therefore need never be considered in calculating the costs at run time. The preselection process of the present invention, therefore, results in increasing the speed of the selection process. In one instance, an increase of 100% has been achieved. It is to be presumed that if a particular triphone does not appear to have an associated list of units, the conventional unit cost selection process will be used.

In general, therefore, for any unit u2 that is to be synthesized as part of the triphone sequence u1-u2-u3, the preselection cost for every possible 5-phone combination ua-u1-u2-u3-ub that contains this triphone is calculated. It is to be noted that this process is also useful in systems that utilize half-phonemes, as long as "phoneme" spacing is maintained in creating each triphone cost that is calculated. Using the above example, one sequence would be k1-æ1-t1 and another would be k2-æ2-t2. This unit spacing is used to avoid including redundant information in the cost functions (since the identity of one of the adjacent half-phones is already a known quantity). In accordance with the present invention, the costs for all sequences ua-k1-æ1-t1-ub are calculated, where ua and ub are allowed to vary over the entire phoneme set. Similarly, the costs for all sequences ua-k2-æ2-t2-ub are calculated, and so on for each possible triphone sequence. The purpose of calculating the costs offline is solely to determine which units can potentially play a role in the subsequent synthesis, and which can be safely ignored. It is to be noted that the specific relevant costs are re-calculated at synthesis time. This re-calculation is necessary, since a component of the cost is dependent on knowledge of the particular synthesis specification, available only at run time.

Formally, for each individual phoneme to be synthesized, a determination is first made to find a particular triphone context that is of interest. Following that, a determination is made with respect to which acoustic units are either within or outside of the acceptable cost limit for that triphone context. The union of all chosen 5-phone sequences is then performed and associated with the triphone to be synthesized. That is:

$$PreslectSet(u_1, u_2, u_3) = \bigcup_{a \in PH} \bigcup_{b \in PH} CC_n(u_a, u_1, u_2, u_3, u_b)$$

where CCn is a function for calculating the set of units with the lowest n context costs and CCn is a function which calculated the n-best matching units in the database for the given context. PH is defined as the set of unit types. The value of "n" refers to the minimum number of candidates that are needed for any given sequence of the form ua-u1-u2-u3-ub.

Figure 5:
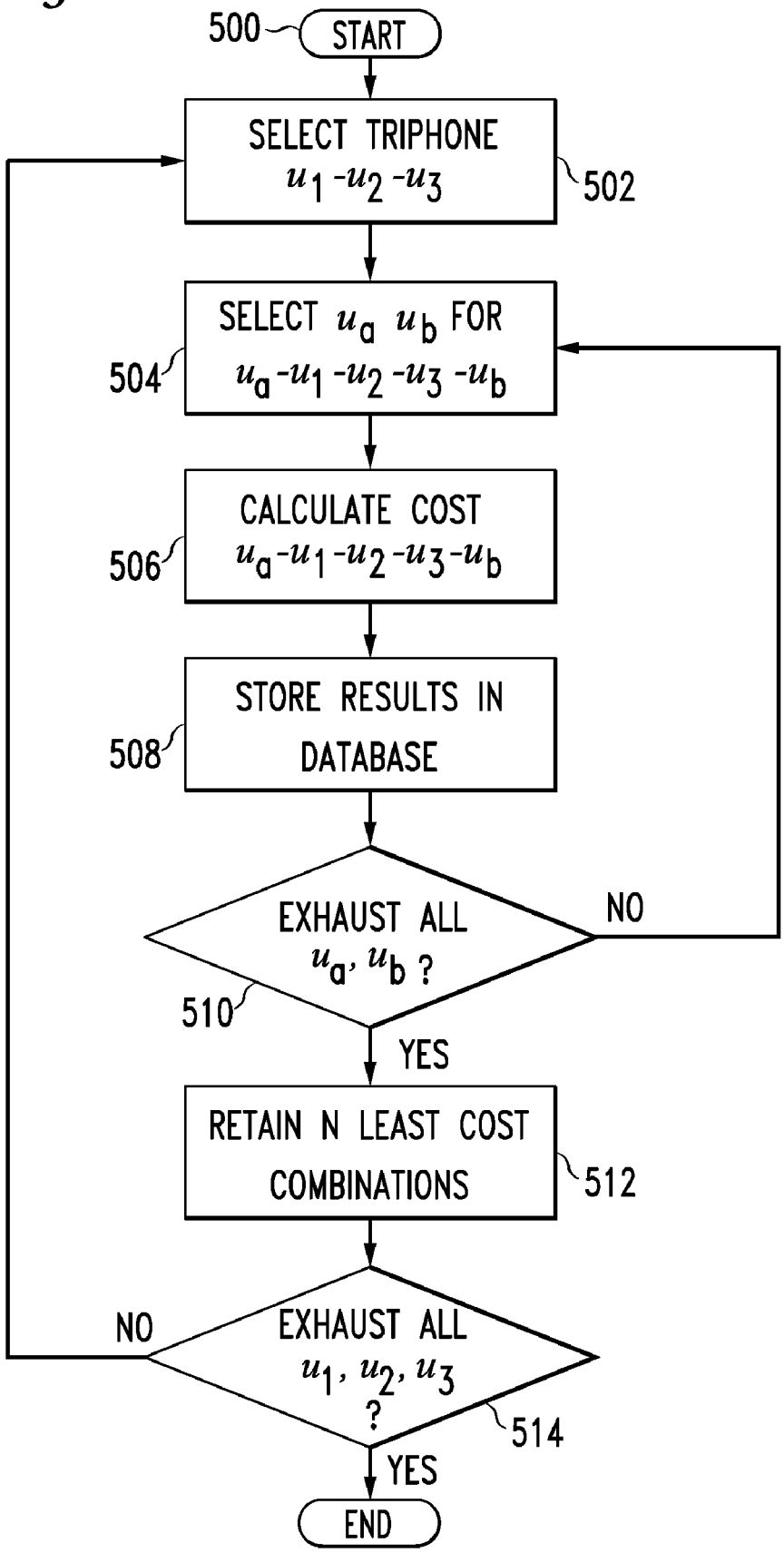
FIG. 5 is a flowchart illustrating the triphone cost precalculation process of the present invention, where the top N units are selected on the basis of cost (the top 50 units for any 5-phone sequence containing a given triphone being guaranteed to be present)

FIG. 5 shows, in simplified form, a flowchart illustrating the process used to populate the triphone cost database used in the system of the present invention. The process is initiated at block 500 and selects a first triphone u1-u2-u3 (block 502) for which preselection costs will be calculated. The process then proceeds to block 504 which selects a first pair of phonemes to be to the "left" ua and "right" ub phonemes of the previously selected triphone. The concatenation costs associated with this 5-phone grouping are calculated (block 506) and stored in a database with this particular triphone identity (block 508). The preselection costs for this particular triphone are calculated by varying phonemes ua and ub over the complete set of phonemes (block 510). Thus, a preselection cost will be calculated for the selected triphone in a 5-phoneme context. Once all possible 5-phoneme combinations of a selected triphone have been evaluated and a cost determined, the "best" are retained, with the proviso that for any arbitrary 5-phoneme context, the set is guaranteed to contain the top N units. The "best" units are defined as exhibiting the lowest target cost (block 512). In an exemplary embodiment, N=50. Once the "top 50" choices for a selected triphone have been stored in the triphone database, a check is made (block 514) to see if all possible triphone combinations have been evaluated. If so, the process stops and the triphone database is defined as completed. Otherwise, the process returns to step 502 and selects another triphone for evaluation, using the same method. The process will continue until all possible triphone combinations have been reviewed and the costs calculated. It is an advantage of the present invention that this process is performed only once, prior to "run time", so that during the actual synthesis process (as illustrated in FIG. 6), the unit selection process uses this created triphone database.

Figure 6:
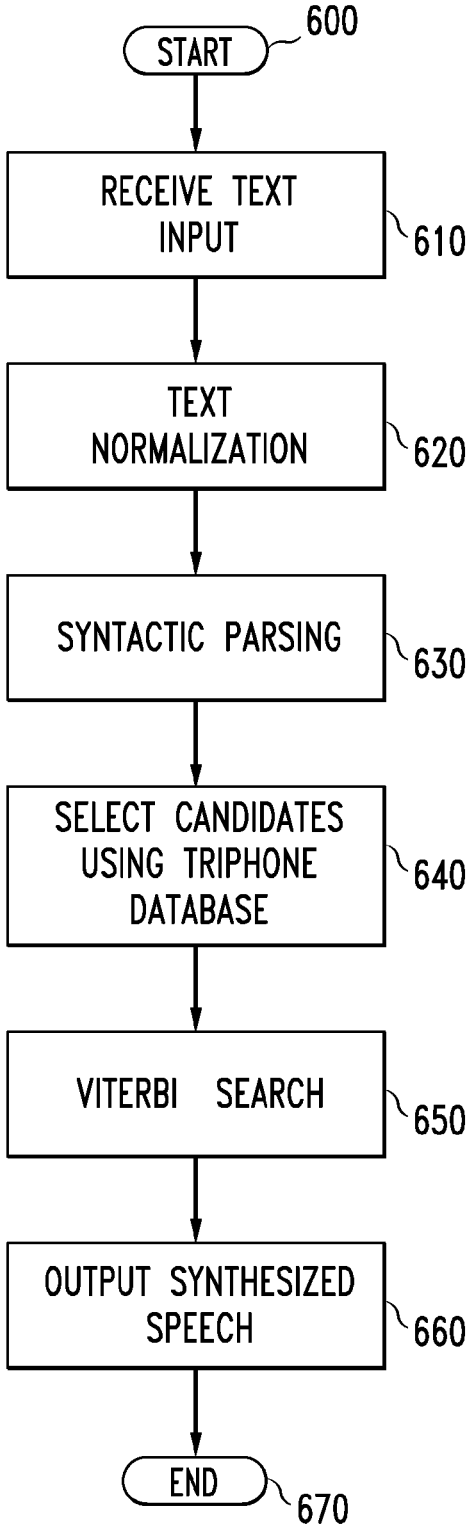
FIG. 6 is a flowchart illustrating the unit (phoneme) selection process of the present invention, utilizing the precalculated triphone-indexed list of units (phonemes).

FIG. 6 is a flowchart of an exemplary speech synthesis system. At its initiation (block 600), a first step is to receive the input text (block 610) and apply it (block 620) as an input to text normalization device 202 (as shown in FIG. 2). The normalized text is then syntactically parsed (block 630) so that the syntactic structure of each constituent phrase or word is identified as, for example, a noun, verb, adjective, etc. The syntactically parsed text is then converted to a phoneme-based representation (block 640), where these phonemes are then applied as inputs to a unit (phoneme) selection module, such as unit selection device 210 discussed in detail above in association with FIG. 2. A preselection triphone database 214, such as that generated by following the steps as outlined in FIG. 5 is added to the configuration. Where a match is found with a triphone key in the database, the prior art process of assessing every possible candidate of a particular unit (phoneme) type is replaced by the inventive process of assessing the shorter, precalculated list related to the triphone key. A candidate list of each requested unit is generated and a Viterbi search is performed (block 650) to find the lowest cost path through the selected phonemes. The selected phonemes may then be further processed (block 660) to form the actual speech output.

Although the above description may contain specific details, they should not be construed as limiting the claims in any way. Other configurations of the described embodiments of the invention are part of the scope of this invention. Accordingly, the appended claims and their legal equivalents should only define the invention, rather than any specific examples given.

What is claimed is:

1. A method comprising:

receiving input text;

when candidate phonemes for synthesizing speech based on the input text are available from a top N triphone units, applying, using a processor, a cost process to select a set of phonemes from the candidate phonemes, wherein the top N triphone units are determined, prior to receiving the input text, from a database comprising a plurality of triphone units, and wherein the top N triphone units comprise those triphone units having lowest target costs when each triphone unit is individually combined into a 5-phoneme combination;

when no candidate phonemes are available in the top N triphone units, applying a single phoneme approach to select single phonemes for synthesis; and synthesizing speech using at least one of the set of phonemes from the candidate phonemes and the single phonemes, which, when used, are used independent of a triphone structure.

2. The method of claim 1, wherein the plurality of triphone units in the database is generated by precalculating a list of all phonemes in a phoneme database that can be used in each of a plurality of triphone contexts.

3. The method of claim 1, wherein applying the single phoneme approach to select phonemes for synthesis is performed using a complete set of phonemes of a given type.

4. The method of claim 1, wherein a Viterbi search is applied as the cost process.

5. The method of claim 1, wherein subsequent to the step of receiving input text, the method comprises parsing the received input text to recognizable units.

6. The method of claim 5, wherein parsing the received text into recognizable units further comprises:

applying a text normalization process to parse the received text into known words and convert abbreviations into known words; and applying a syntactic process to perform a grammatical analysis of the known words and identify their associated parts of speech.

7. A system comprising:

a processor;

a non-transitory computer-readable storage medium storing instructions which, when executed on the processor, perform a method comprising:

receiving input text;

when candidate phonemes for synthesizing speech based on the input text are available from a top N triphone units, applying a cost process to select a set of phonemes from the candidate phonemes, wherein the top N triphone units are determined, prior to receiving the input text, from a database comprising a plurality of triphone units, and wherein the top N triphone units comprise those triphone units having lowest target costs when each triphone unit is individually combined into a 5-phoneme combination;

when no candidate phonemes are available in the top N triphone units, applying a single phoneme approach to select single phonemes for synthesis; and synthesizing speech using at least one of the set of phonemes from the candidate phonemes and the single phonemes, which, when used, are used independent of a triphone structure.

8. The system of claim 7, wherein a Viterbi search is applied as the cost process.

9. The system of claim 7, further comprising instructions to control the processor to parse received text into recognizable units.

10. The system of claim 9, wherein parsing the received text in a recognizable unit further comprises:

applying a text normalization process to parse the received text into known words and convert abbreviations into known words; and applying a syntactic process to perform a grammatical analysis of the known words and identify their associated parts of speech.

11. A non-transitory computer-readable medium storing instructions which, when executed by a computing device, cause the computing device to perform steps comprising:

receiving input text;

when candidate phonemes are available in the top N triphone units applying a cost process to select a set of phonemes from the candidate phonemes, wherein the top N triphone units are determined, prior to receiving the input text, from a database comprising a plurality of triphone units, and wherein the top N triphone units comprise those triphone units having lowest target costs when each triphone unit is individually combined into a 5-phoneme combination;

when no candidate phonemes are available in the top N triphone units, applying a single phoneme approach to select single phonemes for synthesis; and synthesizing speech using at least one of the set of phonemes from the candidate phonemes and the single phonemes, which, when used, are used independent of a triphone structure.

12. The tangible computer-readable medium of claim 11, wherein subsequent to the step of receiving the input text the following step is performed:

parsing the received text into recognizable units.

13. The non-transitory computer-readable medium of claim 12, wherein the parsing comprises the steps of:

applying a text normalization process to parse the input text into known words;

convert abbreviations into the known words; and applying a syntactic process to perform a grammatical analysis of the known words and identify their associated part of speech.

14. The non-transitory computer-readable storage medium of claim 11, wherein the plurality of triphone units in the triphone unit database is generated by precalculating a list of all phonemes in a phoneme database that can be used in each of a plurality of triphone contexts.

15. The non-transitory computer-readable storage medium of claim 11, wherein applying a single phoneme approach further comprises using a complete set of phonemes of a given type.

* * * * *